United States Patent [19]

Gootter

[11] Patent Number: 5,076,569

[45] Date of Patent: Dec. 31, 1991

[54] CONTOURED GRIP FOR EXERCISING THE HAND

[76] Inventor: Steven M. Gootter, 6761 North Longfellow, Tucson, Ariz. 85718

[21] Appl. No.: 580,961

[22] Filed: Sep. 11, 1990

Related U.S. Application Data

[63] Continuation-in-part of Ser. No. 408,077, Sep. 15, 1989, abandoned.

[51] Int. Cl.[5] ..... A63B 23/16

[52] U.S. Cl. ..... 272/68

[58] Field of Search ..... 272/67, 143, 68; 273/75, 81.4, 810

[56] References Cited

U.S. PATENT DOCUMENTS

| | | | |
|---|---|---|---|
| D. 198,695 | 7/1964 | Cameron et al. | 272/68 X |
| 1,229,658 | 6/1917 | Sandow | 272/68 |
| 3,129,939 | 4/1964 | Stock | 272/68 |
| 3,611,807 | 10/1971 | Brandell | 272/68 X |
| 3,910,572 | 10/1975 | Denler | 272/68 |
| 4,840,370 | 6/1989 | Biddlecombe | 272/68 |
| 4,929,211 | 5/1990 | Resnick et al. | 272/68 X |

FOREIGN PATENT DOCUMENTS 0021603 11/1901 United Kingdom .

*Primary Examiner*—Richard J. Apley
*Assistant Examiner*—L. Thomas
*Attorney, Agent, or Firm*—Tod R. Nissle

[57] ABSTRACT

An improved resiliently compressible grip for exercising the hand. The grip is normally grasped between the fingers and palm of a hand and permits the thumb of the hand to be exercised by pressing the tip of the last joint of the thumb against the grip, by pressing the inner ridged pad of the last joint of the thumb against the grip, and by laterally pressing either side of the thumb against the grip.

3 Claims, 2 Drawing Sheets

FIG. 1
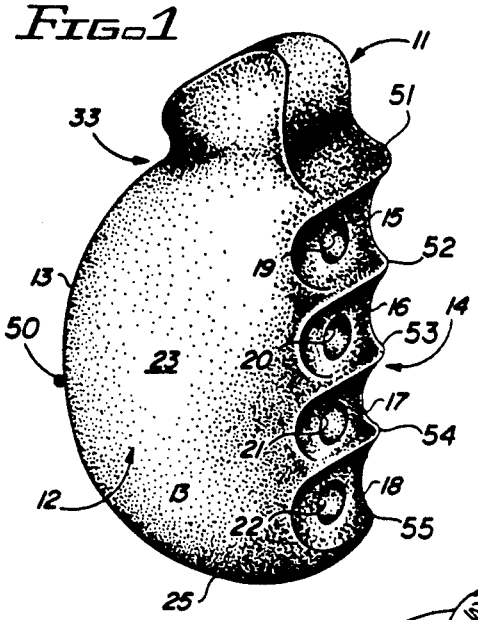
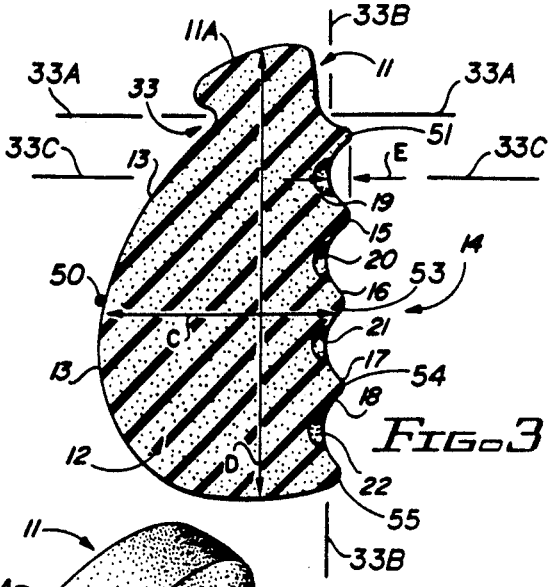
FIG. 3
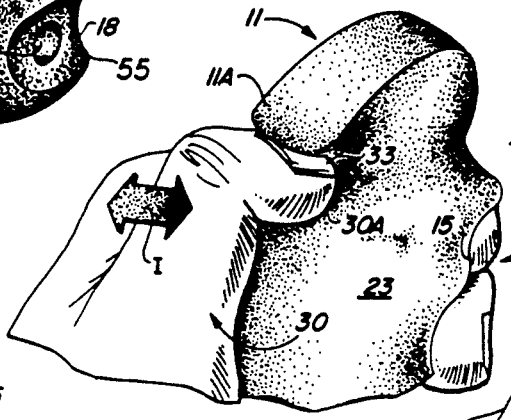
FIG. 4
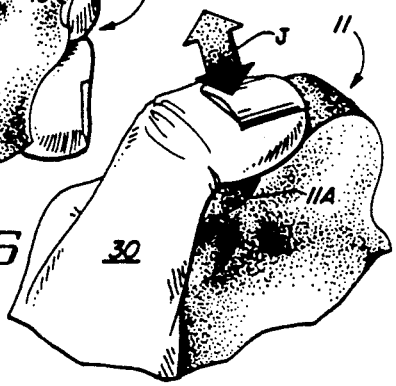
FIG. 5
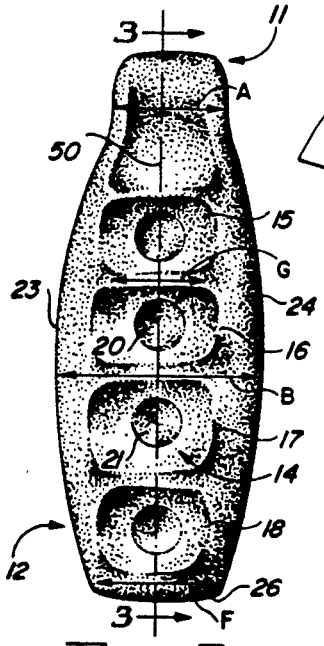
FIG. 2
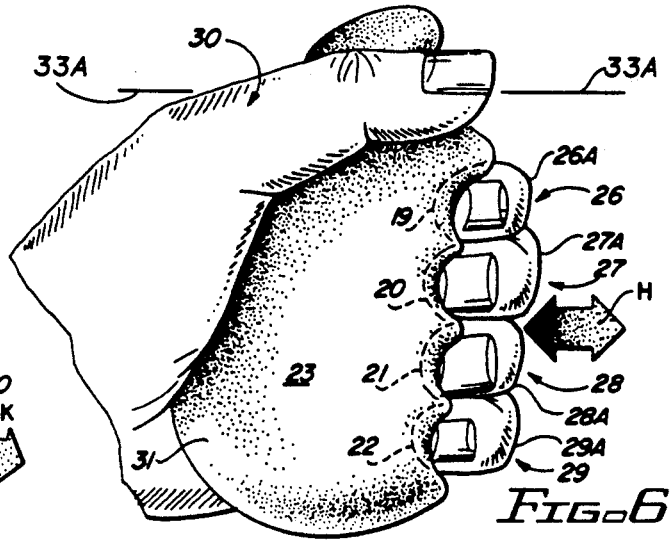
FIG. 6
FIG. 7
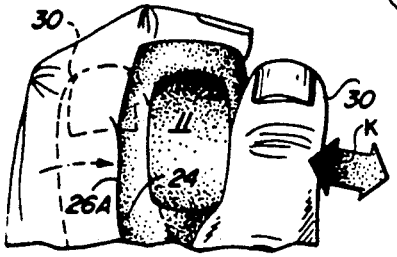

CONTOURED GRIP FOR EXERCISING THE HAND

This application is a continuation-in-part of Ser. No. 07/480,077, filed Sept. 15, 1989, and now abandoned.

This invention relates to exercise apparatus.

More particularly, the invention relates to a resiliently compressible grip for exercising the hand and forearm which is normally grasped between the fingers and palm of a hand, which permits each digit on the hand to be separately exercised, and which permits the thumb of the hand to be exercised by pressing the tip of the last joint of the thumb against the grip, by pressing the inner ridged pad of the last joint of the thumb against the grip, and by laterally pressing either side of the thumb against the grip.

In a further respect, the invention relates to a hand grip which is formed such that its predominant outer surfaces are generally curved and such that its exterior shape and appearance suggest an animal, the particular type of animal depending on the imagination and perception of each individual.

In another respect, the inventions relates to a resiliently compressible grip which, in use, is unusually comfortable to hold because when the grip is initially lightly grasped in the hand, the shape and dimension of the portions of the grip contacted by the hand cause the palm and digits of the hand to be in a position generally corresponding to the position of the digits and palm when the hand is at rest and the fingers and thumb are relaxed and partially curled toward the palm.

Resiliently compressible apparatus for exercising the hand and forearm of an individual is well known in the art. For example, resilient rubber balls have long been grasped and squeezed with the digits of a hand to strengthen the muscles in the hand and forearm. Such prior art apparatus has several drawbacks. The exterior surfaces of the apparatus often do not conform to the normal curvature of the inner surfaces of the lower finger joints and the palm of the hand. Instead, the exterior surfaces of prior art apparatus have edge portions which dig into the fingers and palms, making grasping and holding the apparatus for any length of time uncomfortable. Cylindrical grips and resilient pads which have a generally rectangular shape do not conform to the natural shape of the inner surfaces of a hand and are uncomfortable to grasp and utilize for any extended period of time because they do not tend to uniformly distribute over a substantial portion of the inner surface area of the hand the forces generated during utilization of such apparatus. Another limitation of the prior art apparatus is that it usually only permits the digits of a hand to be exercised by simultaneously contracting and relaxing all of the digits along the same paths of travel. The digits of the hand cannot be exercised by moving the digits in varying directions of travel to isolate different muscle groups in the digits. Finally, prior art apparatus has cylindrical, rectangular or other common geometrical shapes and does not permit an individual to mentally associate the appearance of the apparatus with an animal or some other common object not related to exercise.

Accordingly, it would be highly desirable to provide an improved resiliently compressible device for exercising the hand and forearm, the device tending to uniformly distribute over the palm and inner surface areas of the digits contacted by the device the forces generated when the device is compressively held in the hand.

It would also be highly desirable to provide an improved exercise device which would permit the digits on a hand to be separately exercised and which would have an overall shape and dimension which would cause an individual to associate the appearance of the device with an animal or some other common object not related to exercise.

Therefore, it is an object of the invention to provide improved resiliently compressible apparatus for exercising the hand and forearm of an individual.

Another object of the invention is to provide an improved resiliently compressible grip which is shaped and dimensioned to generally uniformly distribute over the palm and inner digit surfaces contacted by the grip the forces generated when the grip is compressively held in a hand.

A further object of the invention is to provide an improved resiliently compressible grip which, when held, permits each digit on a hand to be separately exercised by pressing against the grip the inner pad or surface of the last joint of the digit, the tip of the last joint of the digit, or a side surface of the digit.

Still another object of the invention is to provide an improved grip which includes a body and a head in a proportion with respect to one another which causes an individual to associate the grip's appearance with an animal or other object unrelated to exercise.

Yet another object of the invention is to provide an improved grip which is shaped such that when the grip is loosely held in a hand, the palm and digits of the hand are in a position generally corresponding to the position of the digits and palm when the hand is at rest with the fingers and thumb relaxed and curled inwardly toward the palm.

These and other, further and more specific objects and advantages of the invention will be apparent to those skilled in the art from the following detailed description thereof, taken in conjunction with the drawings, in which:

FIG. 1 is a perspective view illustrating a resiliently compressible grip constructed in accordance with the principles of the invention;

FIG. 2 is a bottom view further illustrating the curvature of the surfaces of the grip of FIG. 1;

FIG. 3 is a section view of the grip of FIG. 2 illustrating interior construction details thereof and taken along section line 3—3 thereof;

FIG. 4 is a perspective view illustrating the mode of operation of the grip of FIGS. 1-3;

FIG. 5 is a perspective view further illustrating the mode of operation of the grip of FIGS. 1-3;

FIG. 6 is a front perspective view further illustrating the mode of operation of the grip of FIGS. 1-3;

FIG. 7 is a top persepective view also illustrating the mode of operation of the grip of FIGS. 1-3; and, FIGS. 8 and 9 are perspective views of the grip of the invention further illustrating the mode of operation thereof.

Figure 8:
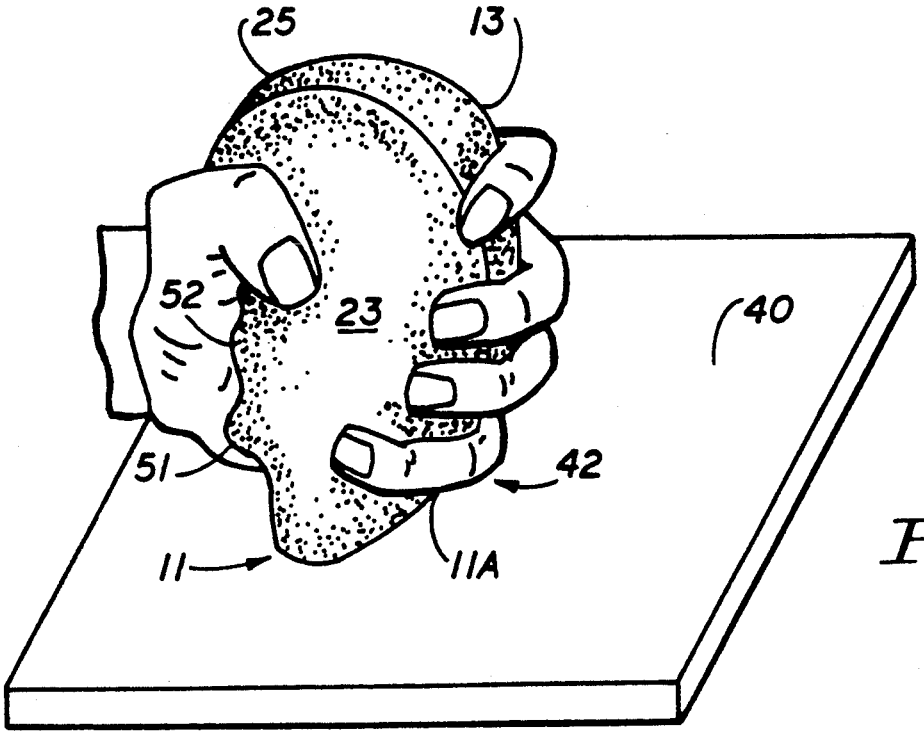

Briefly, in accordance with my invention, I provide an improved contoured grip for exercising the hand and forearm. The grip includes a body of resiliently compressible material having a front end and a back end; and, a head attached to and outwardly extending from the first end of the body. The body includes an arcuate convex spine, a bottom surface, and a pair of arcuate spaced apart convex side surfaces each having an upper portion terminating at the spine and a lower portion terminating at the bottom surface. The grip has mirror image halves on either side of a plane passing midway between and opposed to the side surfaces, and has a preliminary operative position. When the grip is in its preliminary operative position, it is lightly grasped between the palm and fingers of a hand generally without resiliently compressing the body, one of the side surfaces generally conforms to the concave curvature of the upper palm and inner surfaces of the lower finger joints, and, an arcuate length of the spine contacts and generally conforms to the curvature of the central portion of the palm contacted by the spine. The head and body of the grip can be shaped and dimensioned such that when the grip is held in a hand in the preliminary operative position, the thumb of the hand can be exercised by positioning the thumb against one side of the head and pressing the thumb laterally against the head. The grip can include at least one hollow formed in the bottom surface of the grip such that the tip of one of the fingers of the hand can be positioned in the hollow and pressed toward the wrist to compress the resilient material in the body against the palm to exercise the finger. The head and body can also be shaped and dimensioned such that a notch is formed by the head and spine which can, when the grip is held in the preliminary operative position, receive the tip of the thumb such that the thumb can be pressed into the notch toward the forefinger to compress the body between and simultaneously exercise the thumb and forefinger. The head can also be shaped such that when the grip is held in the preliminary operative position, the thumb of the hand can be exercised by positioning the thumb on top of the head and pressing the thumb against the head to force the head into the body of resilient material. The body and head can be formed such that the appearance of the grip suggests an animal.

Turning now to the drawings, which depict the presently preferred embodiments and best mode of the invention for the purpose of illustrating the practice thereof and not by way of limitation of the scope of the invention, and in which like reference characters refer to corresponding elements throughout the several views, FIGS. 1-3 illustrate a grip constructed in accordance with the principles of the invention and including a head 11 attached to the front end of a body 12 having a generally semicircular shape and spine 13. Notch 33 is formed intermediate head 11 and body 12. The bottom surface 14 of body 12 includes finger indents 15-18 with circular hollows 19-22, respectively, formed therein. Arcuate convex sides 23, 24 each have an upper portion which terminates at spine 13 and have a lower portion which terminates at bottom surface 14. The grip is comprised of two mirror image halves lying on either side of an imaginary plane which intersects line 50 in FIG. 2 and is perpendicular to the plane of the sheet of paper of the drawings. This imaginary plane generally passes midway between and is opposed to sides 23, 24. As shown in FIG. 2, the width A of head 11 is less than the width B of body 12. In the presently preferred embodiment of the grip the width of upper surface 11A of head 11 indicated by arrows A is 0.75 inches, the greatest width of body 12 as indicated by arrows B is 1.75 inches, the width of the back end 25 as indicated by arrows F is 1.00 inch, the height of the grip as indicated by arrows C is 2.75 inches, the length of the grip as indicated by arrows D is 5.25 inches, the depth of an indent 15-18 as indicated by arrows E is 0.175 inch, the width of each indent 15-18 as indicated by arrows G is 1.1875 inches, and the width of the spine 13 is 1.00 inches. Spine 13 consists of a planar surface curved in the manner indicated in FIGS. 1 and 3. A length of one inch wide ribbon placed on and along spine 13 would correspond to the surface area of and cover spine 13. In FIG. 3 the surface of spine 13 lies in a curved plane which is perpendicular to the plane of the paper of the drawings and passes through the arcuate line representing the spine 13. Upper surface 11A of head 11 is 0.75 inches wide.

FIGS. 5-7 illustrate the grip of FIG. 1 being used in the left hand. The grip, since it has two mirror image halves, can be similarly used in the right hand. In its preliminary operative position, the grip of FIGS. 1-3 is, without resiliently compressing the grips, lightly grasped in the general manner indicated in FIG. 6, except that instead of the tips of the last or end joints of fingers 26-29 being placed in hollows 19-22, the inner ridged pads of the end joints of fingers 26-29 normally extend over finger indents 15-18 with the inner ridged "fingerprint" pad of the last joint of the index finger 27 (when the grip is held in the left hand) usually extending over and contacting the lower portion of surface 23.

If an individual places his hand back down on the top of a desk or table the palm of the hand is facing up. When the hand is in this position, the fingers can be extended and straightened so they also, along the knuckles and the back of the hand, contact the top of the desk. If, after extending the fingers so they contact the desk top, the individual then completely relaxes his hand and the digits—fingers and thumb—on his hand, the fingers and thumb naturally curl upwardly and inwardly to an "at rest" position in which the digits are completely relaxed and are approximately half way between the position of the digits when a fist is made and the position of the digits when the fingers and thumb are fully extended and straightened against the desk top as earlier described. The grip of the invention is shaped and dimensioned such that when it is placed in a hand in the preliminary operative position, the position of the fingers, palm and thumb as they loosely grasp the grip generally corresponds to the position of the fingers, palm and thumb in the "at rest" position. For this reason the grip of the invention feels very comfortable to hold.

The grip of FIGS. 1-3 also feels very comfortable in use because the convex curvature of sides 23, 24 generally conforms to the concave curvature of the upper palm and inner surfaces of the lower joints of the fingers and thumb when the grip is loosely held in the hand in the preliminary operative position without compressing the resilient material comprising body 12 and head 11. The curvature of the inner surface 26A of the forefinger in FIG. 7 generally conforms to the curvature of surface 24 when the grip is in its preliminary operative position.

The length D of the grip generally corresponds to the shortest distance from the outermost lowermost portion of the heel of the hand to the tip of the thumb when the hand is in the "in rest" position. When the back and knuckles of the left hand are resting on a desk top and the hand is relaxed and in the "at rest" position, the outermost lowermost portion of the heel of the hand comprises the point at the extreme lower right corner of the palm (as seen by the owner of the hand) and immediately adjacent the juncture of the wrist and palm.

When the grip of FIGS. 1-3 is held in the preliminary operative position and the fingers and thumb are squeezed inwardly toward the palm, the muscles in the back of the hand are exercised along with other muscles in the hand and forearm. When the grip of FIG. 1 is held in the manner shown in FIG. 6 with the fingertips in hollows 19-22, and the fingertips are moved toward and away from the palm in the directions indicated by arrows H, the muscles on the outer sides 26A-29A of the middle joints of the fingers are exercised along with the other muscles in the hand and forearm.

A particular advantage of the grip of the invention is that it permits separate muscles in the thumb to be selectively exercised. Once the grip is held in its preliminary operative position, tip 30A of thumb 30 can, as shown in FIG. 4, be positioned in notch 33 and moved in the directions indicated by arrows I to compress and release the grip and to exercise muscles in the middle and lower joints of the thumb. When the inner ridged "fingerprint" pad of thumb 30 is, as shown in FIG. 5, positioned against upper surface 11A of head 11 and moved in the directions indicated by arrows J to compress and release head 11, the muscles on the underside of the thumb and in other parts of the hand and forearm are exercised. Thumb 30 can, as illustrated in FIG. 7, be placed against either side of head 11 and laterally moved in the directions indicated by arrows K to resiliently displace head 11 and exercise muscles extending along the inner and outer sides of thumb 30.

The ability of the grip of the invention to separately focus on and exercise various muscle groups makes the grip particularly useful to individuals who require superior strength and dexterity in their fingers. The grip especially particularly suits the needs of pianists, violinists, typists, and magicians.

In FIG. 3 line 33A passes through the center of notch 33. Line 33A is parallel to arrows E and to arrows C. Notch 33 is formed forwardly of and offset from indent 15. Notch 33 is therefore closer to surface 11A than is indent 15. Arrow D is perpendicular to arrows C, arrows E, and to line 33A. Line 33B passes through the bottom of each indent 15-18 and is perpendicular to line 33A, arrows C and arrows E. The shortest distance from foot 51 to surface 11A can be defined by a first reference line. The first reference line is parallel to arrows D and perpendicular to a second reference line which passes through foot 51 and is parallel to arrows C and E. The first reference line is the shortest distance from the second reference line to a selected point on surface 11A. The shortest distance from notch 33 to surface 11A can be indicated by a third reference line. The third reference line is parallel to arrows D and perpendicular to line 33A passing through notch 33. The third reference line is the shortest distance from line 33A to said selected point on surface 11A. Line 33A is parallel to arrows C and perpendicular to arrows D. The shortest distance (indicated by said third reference line) from notch 33 to surface 11A is less than the shortest distance (indicated by said first reference line) from foot 51 to surface 11A. In other words, notch 33 is forward of and is closer to surface 11A than is indent 15. This is important in utilizing the invention in the manner illustrated in FIG. 4. If notch 33 is formed along back 13 in a position such that line 33C passes through the notch, then the notch is opposed to or above the indent 15. If notch 33 is formed above indent 15, it is, when the grip is held with the four fingers either in the orientation shown in FIG. 6 or in the orientation shown in FIGS. 4 and 7, difficult if not impossible to crick the thumb to the position shown in FIG. 4. The anatomy of the thumb does not permit such a marked pull back of the thumb toward the wrist while the four fingers maintain the orientation of FIGS. 4, 6, or 7. In FIGS. 4, 6, or 7 the bones in each finger are generally parallel to line 33A. When the grip is loosely held in the hand in the grip's preliminary operative position, the four fingers other than the thumb extend across indents 15 to 18 in the manner suggested in FIGS. 4 and 7. To facilitate use of the invention to exercise the thumb, it is important that notch 33 be formed forwardly of indent 15 and that notch 33 therefore be closer to surface 11A than indent 15, and that notch 33 not be opposed to or above indent 15. Indent 15 receives the index finger of the user's hand. Each indent 15 to 18 is bounded by a pair of feet 51, 52, 53, 54, and 55.

Another manner in which the grip or the invention can be utilized to exercise the thumb is by extending the thumb to either side of head 4 in the manner illustrated in FIG. 6 and by then laterally displacing the thumb in the directions of arrow K as shown in FIG. 7. The lateral thumb exercise does not appear utilized in prior art grips. For example, as shown in FIG. 1 of U.S. Pat. No. 3,129,939 to Stock, during use of the Stock grip the thumb is bent over an edge 18 is not extended. Similarly, in British Patent No. 21,603 to Caines, the grip is apparently not intended to permit the lateral exercise (shown in FIG. 7 of Applicant's drawings). In the Caines Patent there is no notch formed on the "back" of the grip. The very modest hollow formed at the base of the thumbpiece of the Caines grip is above and opposes the indent which receives the forefinger of a hand. Accordingly, after the user grasps the Caines grip in normal fashion, attempting to position the tip of the thumb in the small hollow on the back of the grip is very awkward, if not physically impossible. Further, the Caines grip does not utilize a head which has a smaller width than the body of the grip so the thumb can be readily positioned to either side of the head. As shown in FIG. 7 of the application drawings, the head of the grip of the invention is sized to permit the user to readily position the thumb to either side of the head. The unusual shape of the Caines grip does not permit such a lateral positioning of the thumb. The thumbpiece in Caines is too large. Even if the thumbpiece were smaller, the unusual sloped surface contour of the thumbpiece causes the thumb to slide off of the side of the thumbpiece. An individual using the Caines grip would crook or bend his thumb about thumbpiece A in much the same fashion that the user's thumb is bent around the grip in U.S. Pat. No. 3,129,939. The channel C in the Caines grip is made to give when the thumb presses inwardly on thumbpiece A.

Finally, a sloped surface 11A facilitates, in the grip of the invention, exercising the thumb 30 of a hand while the thumb is in extended around the head of the grip. The grips described in the British Patent No. 21,603 and U.S. Pat. No. 3,129,939 to Stock require that the thumb be bent when the thumb is contoured around one end of the grip.

One of the principal advantages of the grip of the invention is that it permits the thumb to be exercised in five separate positions. FIGS. 4, 5, 6, and 7 illustrate four of these positions. The fifth position is achieved when the thumb in FIG. 7 is moved to the opposite (or in FIG. 7 the left side) of the head 11.

In FIG. 8, the grip of the invention is held with the bottom surface 14 bearing against the lower palm of the left hand, with convex side 24 bearing against the central and upper palm and the lower or metacarpal finger joints, with the center phalange joints of the four fingers extending at least partially across the spine 13, with the lower phalange joint of the little finger resting in notch 33, and with the tips of the four fingers contacting side 23. Head 11 of the grip is resting against the top of table 40 to minimize the stress acting on the muscles of the arm and of shoulder associated with the left hand.

Figure 9:
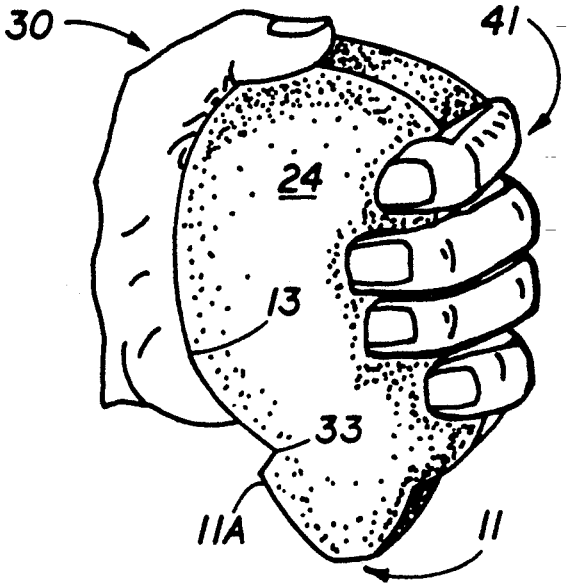

In FIG. 9, the grip of the invention is held with the spine 13 bearing against the lower palm of the left hand, with convex side 23 bearing against the central and upper palm and the lower or metacarpal joints of the four fingers, with the center phalange joints of the four fingers extending at least partially across the bottom surface 14, and with the tips of the four fingers contacting side 24. If desired, in FIG. 9 head 11 could also be resting against the top of table 40. When, in FIGS. 8 and 9, head 11 rests on a table top and the grip of the invention is held in the manner shown, the wrist and forearm associated with the left hand are supported above and spaced apart from the top of table 40.

When the thumb 30 extends along the curved end 25 and spine 13 with the tip of the thumb generally perpendicular to the phalange at the end of the forefinger 41, the grip of the invention can, as shown in FIG. 9, be used to focus on exercising the forefinger 41. Similarly, when the grip of the invention is grasped in the manner shown in FIG. 8, exercise of the small finger 42 is facilitated.

Having described my invention in such terms as to enable those skilled in the art to understand and practise it, and having identified the presently preferred embodiments thereof, I claim:

1. A contoured grip for exercising the hand and forearm, comprising (a) a V-shaped notch having a bottom and two sides each diverging upwardly away from said bottom;

(b) a body of resiliently compressible material having a front end and a back end and including (i) an arcuate spine extending from said back end to said front end and having a portion which forms one of said sides of said notch, (ii) a bottom surface spaced apart from and opposing said spine, and (iii) a pair of spaced apart side surfaces each having an upper portion terminating at said spine and a lower portion terminating at said bottom surface;

(c) a head of resiliently compressible material attached to and outwardly extending from said front end of said body and having (i) first and second substantially flat sides, (ii) a nose, (iii) a top extending between said sides and from said notch to said nose, and (iv) a portion forming the other of said sides of said notch, said other side of said notch extending upwardly and outwardly away from said bottom surface of said grip; and, (d) a longitudinal axis passing through said body generally between and parallel to said side surfaces, said grip being shaped and dimensioned such that when said body is lightly grasped between the palm and bent fingers of a hand generally without resiliently compressing said body and with the thumb at said front end of said body and with the remaining four fingers extending over said bottom surface and partially circumscribing said longitudinal axis and with the tip of the thumb pointing toward the forefinger, (e) one of said side surfaces contacts the upper palm and inner surface of the lower joints of the remaining four fingers;

(f) the thumb extends along the other of said side surfaces;

(g) an arcuate length of said spine contacts and generally conforms to the curvature of the central portion of the palm contacted by said spine;

(h) the thumb and forefinger of the hand are the fingers closest to said head and said head extends outwardly from said thumb and forefinger;

(i) the thumb of the hand can, while the position of the remaining four fingers and of the central portion of the palm in contact with said grip is maintained, be moved from contact with the other of said side surfaces, extended so the phalanges of the thumb are co-linear and pointing outwardly away from said body and said forefinger, and placed in any of the three positions in the group consisting of (i) a first position against one of said sides of said resilient head to be laterally pressed against said head, (ii) a second position against said top of said resilient head to compress said head toward said back end and bottom surface of said grip, (iii) a third position against the other of said sides of said resilient head to be laterally pressed against said head;

(j) the thumb of the hand can, while the position of the remaining four fingers and of the central portion of the palm in contact with said grip is maintained, be moved from contact with the other of said side surfaces and comfortably bent with the tip of the thumb in said bottom of said V-shaped notch to compress said body toward the forefinger and toward said bottom surface of said grip; and, (k) when the tip of the thumb is in said notch, said other side of said notch bears against the outer surface of the thumbnail to prevent the tip of the thumb from being moved outwardly away from the palm of the hand toward said nose of said head.

2. A method of exercising the hand, comprising the steps of (a) manually grasping a contoured grip in a first operative position, said grip including (i) a V-shaped notch having a bottom and two sides each diverging upwardly from said bottom;

(ii) a body of resiliently compressible material having a front end and a back end and including an arcuate spine extending from said back end to said front end and having a portion which forms one of said sides of said notch, a bottom surface spaced apart from and opposing said spine, and a pair of spaced apart side surfaces each having an upper portion terminating at said spine and a lower portion terminating at said bottom surface;

(iii) a head of resiliently compressible material attached to and outwardly extending from said front end of said body and having first and second substantially flat sides, a nose, a top extending between said sides and from said notch to said nose, and a portion forming the other of said sides of said notch, said other side of said notch extending upwardly and outwardly away from said bottom surface of said grip; and, (iv) a longitudinal axis passing through said body generally between and parallel to said side surfaces, the distance from said bottom of said notch to said bottom surface being shorter than the distance to said bottom surface from any point along said spine, said grip being shaped and dimensioned such that when said body is lightly grasped in said first operative position between the palm and bent fingers of a hand generally without resiliently compressing said body, (v) the thumb is at said back end of said body with the remaining four fingers extending over said spine and partially circumscribing said longitudinal axis and with the tip of the thumb pointed toward the forefinger of the hand, (vi) one of said side surfaces contacts the upper palm and inner surface of the lower finger joints, (vii) a portion of said bottom surface contacts the palm of the hand, and, (viii) the little finger of the hand is closest to said head and extends through said notch over to the other of said side surfaces such that said head extends outwardly from said little finger and the hand so said head can rest against a table top and maintain the hand and the forearm above and spaced apart from the table top;

(b) placing said head of said grip on a table top with the hand and forearm spaced above the table top to reduce the muscular stress on the arm and shoulder associated with the hand and forearm; and, (c) squeezing said grip with the hand, said distance between said bottom of said notch and said bottom surface enabling the little finger to more readily curl up in comparison to the other of said four fingers when said grip is squeezed.

3. A method of exercising the hand, comprising the steps of (a) manually grasping a contoured grip in a first operative position, said grip including (i) a body of resiliently compressible material having a front end and a back end and including an arcuate spine extending from said back end to said front end, a bottom surface spaced apart from and opposing said spine, and a pair of spaced apart side surfaces each having an upper portion terminating at said spine and a lower portion terminating at said bottom surface, (ii) a head of resiliently compressible material attached to outwardly extending from said front end of said body, (iii) a longitudinal axis passing through said body generally between and parallel to said side surfaces, said grip being shaped and dimensioned such that when said body is lightly grasped in said first operative position between the palm and bent fingers of a hand generally without resiliently compressing said body, (iv) the thumb is at said front end of said body with the remaining four fingers extending over said bottom surface and partially circumscribing said longitudinal axis and with the tip of the thumb pointed toward the forefinger of the hand, (v) one of the said side surfaces contacts the upper palm and inner surface of the lower finger joints, (vi) said thumb extends along the other of said side surfaces, (vii) an arcuate length of said spine contacts and generally conforms to the curvature of the central portion of the palm contacted by said spine, and, (viii) the thumb and forefinger of the hand are the fingers closest to said head and said head extends outwardly from the thumb and forefinger so said head can rest against a table top and maintain the hand and the forearm above and spaced apart from the table top;

(b) placing said head of said grip on a table top with the hand and forearm spaced above the table top to reduce the muscular stress on the arm and shoulder associated with the hand and, (c) squeezing said grip with the hand.

* * * * *